US008215516B2

(12) United States Patent
Kaupp

(10) Patent No.: US 8,215,516 B2
(45) Date of Patent: Jul. 10, 2012

(54) PORTABLE FLUID STORAGE TANK AND METHOD OF USE

(76) Inventor: Patrick A. Kaupp, Medicine Hat (CA)

( * ) Notice: Subject to any disclaimer, the term of this patent is extended or adjusted under 35 U.S.C. 154(b) by 459 days.

(21) Appl. No.: 12/498,415

(22) Filed: Jul. 7, 2009

(65) Prior Publication Data

US 2011/0006068 A1 Jan. 13, 2011

(51) Int. Cl.
*B65D 88/12* (2006.01)

(52) U.S. Cl. ..... 220/562; 220/563

(58) Field of Classification Search ..... 220/562, 220/563, 564, 567, 631, 636, 637, 1.5; 280/837
See application file for complete search history.

(56) References Cited

U.S. PATENT DOCUMENTS

| | | | | | |
|---|---|---|---|---|---|
| 2,399,167 | A | * | 4/1946 | Chouinard | 141/96 |
| 2,664,911 | A | * | 1/1954 | Thompson et al. | 137/205 |
| 2,712,797 | A | * | 7/1955 | Woehrle et al. | 296/39.1 |
| 2,995,268 | A | * | 8/1961 | Kurtovich | 244/135 R |
| 3,250,437 | A | | 5/1966 | Smith | |
| 3,625,137 | A | | 12/1971 | Johnson | |
| 3,886,978 | A | * | 6/1975 | Deeks | 138/103 |
| 4,148,528 | A | * | 4/1979 | Channell | 298/22 J |
| 4,199,298 | A | | 4/1980 | Webre, Jr. et al. | |
| 4,318,549 | A | | 3/1982 | Pletcher | |
| 4,344,636 | A | * | 8/1982 | van der Lely | 280/837 |
| 4,552,166 | A | * | 11/1985 | Chadbourne et al. | 137/15.04 |
| 4,589,565 | A | * | 5/1986 | Spivey | 220/671 |
| 5,004,269 | A | | 4/1991 | Pelt | |
| 5,098,019 | A | * | 3/1992 | Landefeld | 239/172 |
| 5,213,367 | A | * | 5/1993 | Norman et al. | 280/837 |
| D348,304 | S | | 6/1994 | Norman, Jr. et al. | |
| D353,352 | S | | 12/1994 | Holloway, Jr. | |
| D375,470 | S | | 11/1996 | Adams | |
| 5,582,311 | A | | 12/1996 | Bartenstein et al. | |
| D378,810 | S | | 4/1997 | Norman, Jr. et al. | |
| D379,948 | S | | 6/1997 | Wade | |
| 5,671,855 | A | * | 9/1997 | Norman et al. | 220/1.5 |
| D384,913 | S | | 10/1997 | Norman, Jr. et al. | |
| 5,938,065 | A | | 8/1999 | De Vivo et al. | |
| 5,957,500 | A | | 9/1999 | Wade | |
| 6,152,492 | A | * | 11/2000 | Markham et al. | 280/837 |
| 6,199,910 | B1 | | 3/2001 | Wade | |
| D441,692 | S | | 5/2001 | Niblett et al. | |
| 6,279,955 | B1 | * | 8/2001 | Fisher | 280/837 |
| 2008/0179324 | A1 | * | 7/2008 | McGough et al. | 220/8 |

FOREIGN PATENT DOCUMENTS

| | | |
|---|---|---|
| EP | 0601774 | 6/1994 |

* cited by examiner

*Primary Examiner* — Anthony Stashick
*Assistant Examiner* — Christopher McKinley
(74) *Attorney, Agent, or Firm* — Nelson Mullins Riley & Scarborough, LLP

(57) ABSTRACT

A portable fluid storage tank has through pipes with opposed ends that extend through the tank at two separate places so that the opposed ends are exposed on an exterior of the portable fluid storage tank and the each through pipe provides a separate fluid path through the portable fluid storage tank without fluid communication between the through pipes or an interior of the portable fluid storage tank. Several rows of the portable fluid storage tanks can be connected to a single frac manifold to reduce well site space usage.

20 Claims, 10 Drawing Sheets

PORTABLE FLUID STORAGE TANK AND METHOD OF USE

FIELD OF THE INVENTION

This invention relates in general to portable fluid storage tanks and, in particular, to a large capacity portable fluid storage tank used to store well fracturing fluids.

BACKGROUND OF THE INVENTION

Portable fluid storage tanks used to store well fracturing fluids are well known in the art. Such tanks are available in two general types: trailer tanks and skidded tanks. Trailer tanks are horizontal tanks shaped much like a semi-truck trailer and have at least one rear axle with wheels. Trailer tanks generally have a capacity of about 350-500 barrels. They are towed by a trailer tractor to a well site and parked in side-by-side and back-to-back double rows. A frac manifold must be installed between each pair of double rows to pump fluid from the tanks. Skidded tanks are cylindrical tanks with skids welded to a side surface. The skidded tanks generally have a capacity of about 200-500 barrels. The skidded tanks are transported to a well site on specially designed trucks or trailers, where they are offloaded and normally tipped to an upright position using cables or chains pulled by winches or a suitable vehicle.

Each type of tank has its advantages and disadvantages. Trailer tanks have a low profile but occupy a large area per barrel of fluid capacity. Skidded tanks, once tipped upright, occupy less area per barrel of fluid capacity, but they require much more handling, space for the tipping operation, and they cannot be as closely packed because of the tipping operation.

Fracturing a gas well in a shale formation, for example, often requires a very large volume of fracturing fluid. Since it is only economical to fracture the well in a single uninterrupted procedure due to equipment rental and labor costs, all of the required fracturing fluid must be stored at the well site before the fracturing operation begins. If a large frac is to be performed, an appropriately sized area around the well must be prepared for the frac tanks and other equipment required to perform the fracturing operation. The required area must be acquired or leased, graded and, if necessary, covered with an appropriate surface aggregate. All of this is time-consuming, expensive and environmentally undesirable. It is therefore desirable to keep the well site as small as possible. In order to facilitate this, space-efficient fluid storage is advantageous.

There therefore exists a need for a portable fluid storage tank that provides space-efficient fluid storage.

SUMMARY OF THE INVENTION

It is therefore an object of the invention to provide a portable fluid storage tank that has a small footprint to provide space-efficient fluid storage.

The invention therefore provides a portable fluid storage tank, comprising: a base that supports the portable fluid storage tank in an upright position; a bottom wall connected to the base; at least one sidewall connected to the bottom wall; a top wall connected to the at least one sidewall; at least one through pipe having opposed ends, the at least one through pipe extending through the at least one sidewall at two separate places so that the respective opposed ends of the at least one through pipe are exposed on an exterior of the portable fluid storage tank and the at least one through pipe provides a fluid path through the portable fluid storage tank without fluid communication between the at least one through pipe and an interior of the portable fluid storage tank; and, at least one drain valve through which fluid may be removed from the portable fluid storage tank.

The invention further provides a portable fluid storage tank, comprising: a base that supports the portable fluid storage tank in an upright position; a bottom wall connected to the base; four sidewalls connected to the bottom wall; a top wall connected to the four sidewalls; a plurality of through pipes respectively having opposed ends, the plurality of through pipes respectively extending through two opposed ones of the four sidewalls, so that the respective opposed ends of the respective plurality of through pipes are exposed on an exterior of the portable fluid storage tank and the plurality of through pipes respectively provide a fluid path through the portable fluid storage tank without fluid communication between any one of the plurality of through pipes and an interior of the portable fluid storage tank; and, at least one drain valve through which fluid may be removed from the portable fluid storage tank.

The invention yet further provides a method of storing fracturing fluid at a well site, comprising: arranging at the well site a plurality of portable fluid storage tanks in rows and columns, the portable fluid storage tanks respectively comprising a plurality of through pipes that provide a fluid path through the respective portable fluid storage tanks without fluid communication between any one of the through pipes and an interior of the respective portable fluid storage tanks and at least one drain valve through which fluid may be removed from the portable fluid storage tank, the rows and columns being arranged so that a first row faces a frac manifold, and the number of rows in each column does not exceed the number of through pipes in each of the plurality of portable fluid storage tanks, plus one; connecting the drain valves of the portable fluid storage tanks in the first row directly to the frac manifold; and interconnecting the drain valves of the respective portable fluid storage tanks in the remaining rows to a through pipe in a next row closer to the frac manifold to commence a segregated fluid path to the frac manifold, daisy chaining each through pipe in a segregated fluid path to a through pipe in the first row, and connecting to the frac manifold each through pipe in the first row that forms part of one of the segregated fluid paths to create a complete segregated fluid path from each drain valve to the frac manifold.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a portable fluid storage tank especially adapted to store fracturing fluid used for well stimulation procedures. The portable fluid storage tank has a small footprint, a large fluid capacity, and through pipes that permit efficient use of well site space by enabling the connection of a plurality of rows of portable fluid storage tanks to a single frac manifold. Thus well site space and frac manifold rental expenses are reduced. The portable fluid storage tank also has a top end walkway with handrails to permit well site personnel to walk more safely across a top of rows of the portable fluid storage tanks, when required.

Figure 1:
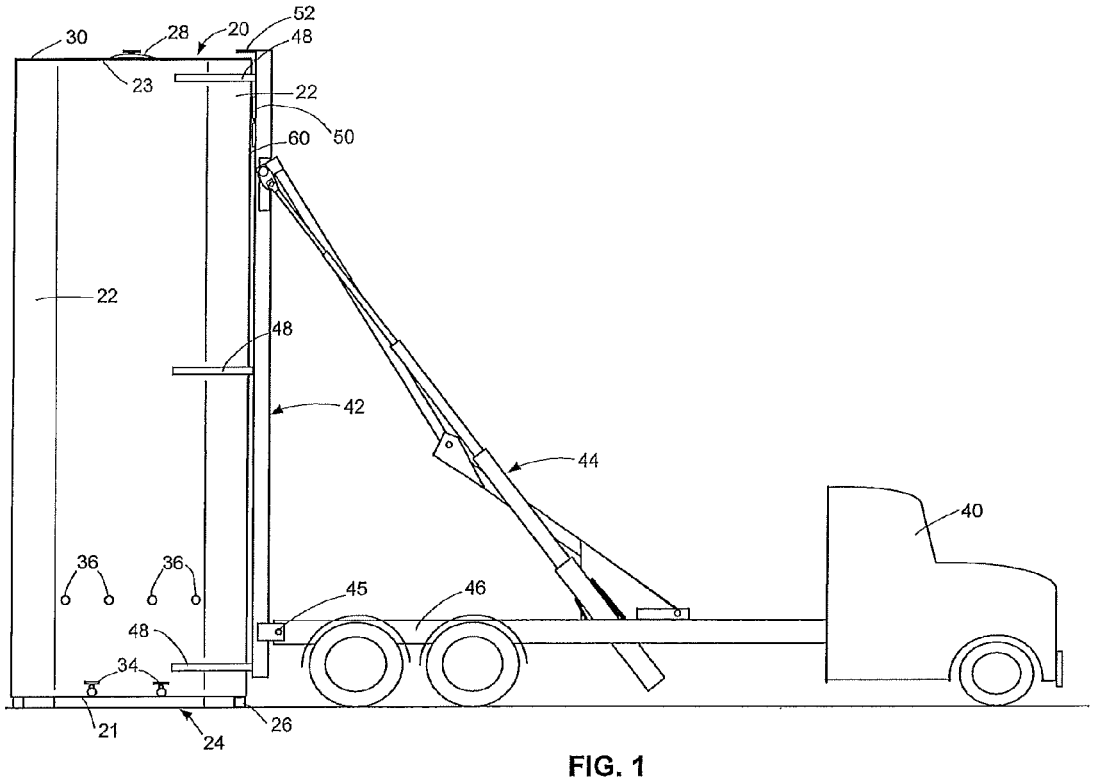
FIG. 1 is a schematic side elevational view of an embodiment of a portable fluid storage tank in accordance with the invention, showing a truck with a tilting bed used to transport the portable fluid storage tank to a well site.

FIG. 1 is a schematic side elevational view of one embodiment of a portable fluid storage tank 20 in accordance with the invention. In this embodiment, the portable fluid storage tank 20 is substantially square with rounded corners 22. In one embodiment, the portable fluid storage tank 20 is about 11'×11' (3.35×3.35 m) and the rounded corners 22 each have a radius of about 2' (0.61 m). A tank of this dimension with a height of about 30' (9.15 m) has a capacity of about 750 barrels (119,242 L). In one embodiment the portable fluid storage tank 20 is constructed of ¼" (6.3 mm) mild steel and has a weight of about 15,000 lb (6,818 kg). For corrosive fluid applications, the portable fluid storage tank 20 may be constructed of galvanized or stainless steel.

The portable fluid storage tank 20 is supported on a cross-shaped base 24 constructed from a plurality of 6'×6' (15×15 cm) square steel tubes 26 welded to a bottom wall 21 of the portable fluid storage tank 20, as will be explained below in more detail with reference to FIG. 2. The square steel tubes 26 have a wall thickness of about ⅜" (9.53 mm). A top wall 23 of the portable fluid storage tank 20 is constructed with a covered manhole 28. A collapsible handrail 30 and a walkway 32 (see FIG. 3) are also connected to the top wall 23, as will be explained in more detail below with reference to FIG. 3.

In this embodiment, the portable fluid storage tank 20 includes at least two drain valves 34, typically butterfly valves located adjacent the bottom wall 21 of the portable fluid storage tank 20. The drain valves have an internal diameter of about 4" (10 cm). The portable fluid storage tank also includes a plurality of through pipes 36, which respectively extend completely through and are welded to opposite sidewalls of the portable fluid storage tank 20. The through pipes 36 provide fluid passages through the portable fluid storage tank 20 to permit fluid to be pumped from other portable fluid storage tanks 20, as will be explained below in more detail with reference to FIGS. 6 and 11. Each of the through pipes 36 also has a diameter of about 4" (10 cm).

The portable fluid storage tank 20 is transported by truck 40 having a tilting bed 42. The tilting bed 42 is raised and lowered by a scissor frame 44 similar to one described, for example, in U.S. Pat. No. 4,148,528, which issued on Apr. 10, 1979 to Channell, the specification of which is incorporated herein by reference. The tilting bed 42 pivots around pivot pins 45 journaled through bearings installed in a rear end of the truck frame 46. A tank cradle having tank cradle arms 48 supports the portable fluid storage tank 20 on the tilting bed 42. The tank cradle arms 48 are curved to match the rounded corners of the portable fluid storage tank 20 as will be described below in more detail with reference to FIG. 7. Hydraulic latches 50, described below in more detail with reference to FIGS. 9 and 10, in cooperation with a tilting bed end plate 52 secure the portable fluid storage tank 20 to the tilting bed 42. As will be explained below in more detail with reference to FIG. 8, the hydraulic latches 50 engage latch windows in a sidewall 60 of the portable fluid storage tank 20 and lift the portable fluid storage tank 20 upwardly until the top end wall 23 of the portable fluid storage tank 20 abuts the tilting bed end plate 52 to lock the portable fluid storage tank 20 to the tilting bed 42.

Figure 2:
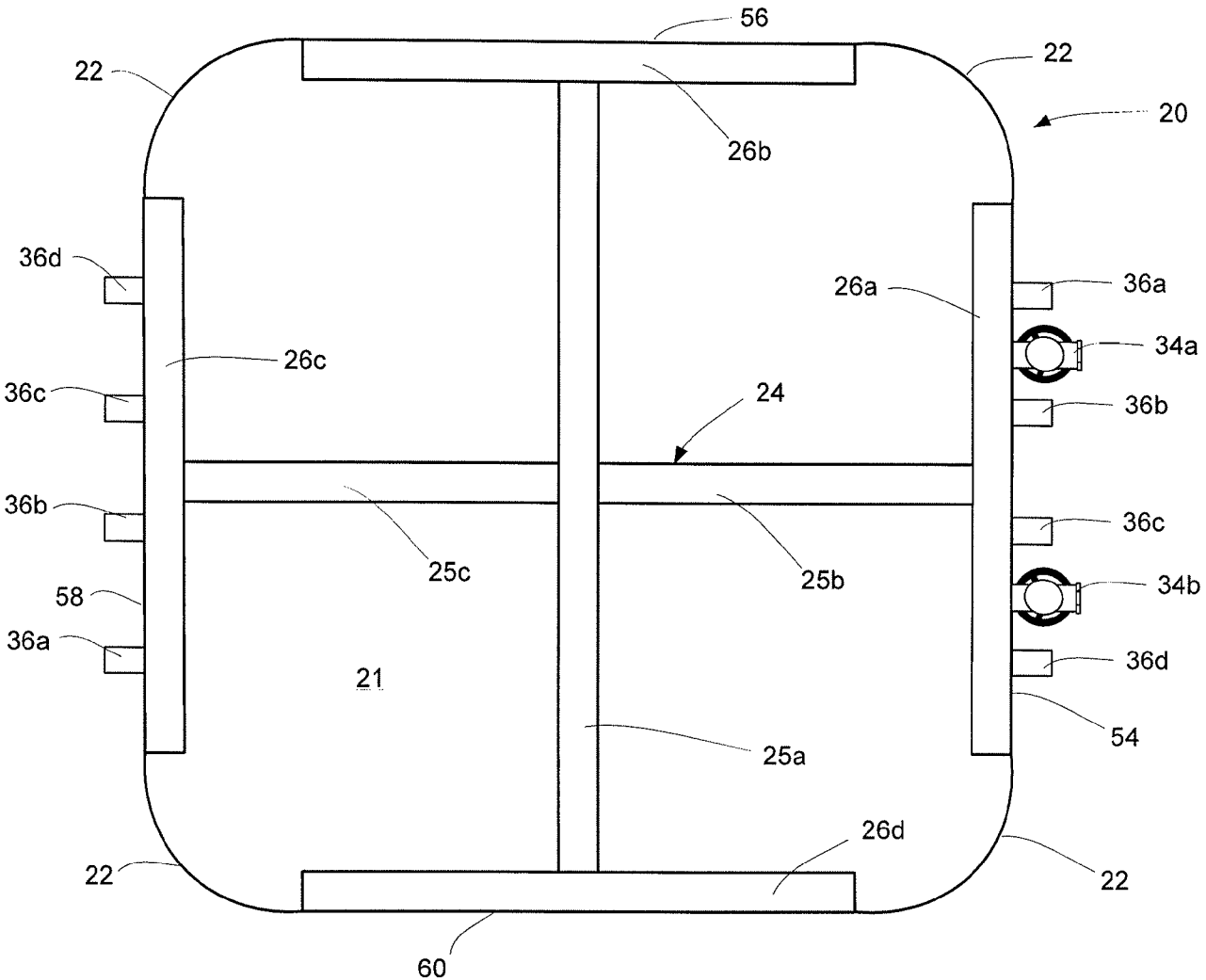
FIG. 2 is a schematic bottom plan view of the portable fluid storage tank shown in FIG. 1.

FIG. 2 is a schematic bottom plan view of the portable fluid storage tank 20 shown in FIG. 1. As explained above, the portable fluid storage tank 20 is supported on a base 24 constructed from a plurality of 6'×6' (15.24×15.24 cm) square steel tube side members 26*a*-26*d* having a wall thickness of about ⅜" (9.5 mm). The steel tube side member 26*a* is welded to the bottom wall 21 of the portable fluid storage tank 20 along a bottom edge of the front wall 54. The steel tube side member 26*b* is welded to the bottom wall 21 of the portable fluid storage tank 20 along a bottom edge of a left sidewall 56. The steel tube side member 26*c* is welded to the bottom wall 21 along a bottom edge of a rear sidewall 58, and the steel tube side member 26*d* is welded to the bottom wall 21 along a bottom edge of a right sidewall 60. A steel tube cross-member 25*a* of the same dimension is welded between the steel tube side members 26*b* and 26*d*. A steel tube cross-member 25*b* is welded between the cross-member 25*a* and the steel tube side member 26*a*, and a steel tube cross-member 25*c* is welded between the cross-member 25*a* and the steel tube side member 26*c*. The steel tube base 24 not only securely supports the portable fluid storage tank 20, but also provides open channels into which steam, or the like, can be directed to release the portable fluid storage tank 20 if it freezes to the ground, which can occur under certain winter conditions.

As also explained above, two drain valves 34*a*, 34*b* are secured to a bottom of the front wall 54. Fluid is pumped from the portable fluid storage tank 20 through one or both of the drain valves 34*a*, 34*b*. In this embodiment, four through pipes 36*a*-36*d* are provided. Each through pipe 36*a*-36*d* extends completely through the portable fluid storage tank 20 and is welded to the respective front wall 54 and a rear wall 58. As will be explained below in more detail with reference to FIG. 6, the through pipes 36*a*-36*d* provide a fluid flow path through the portable fluid storage tank 20, but there is no fluid communication between the through pipes 36*a*-36*d* and the inside of the portable fluid storage tank 20.

Figure 3:
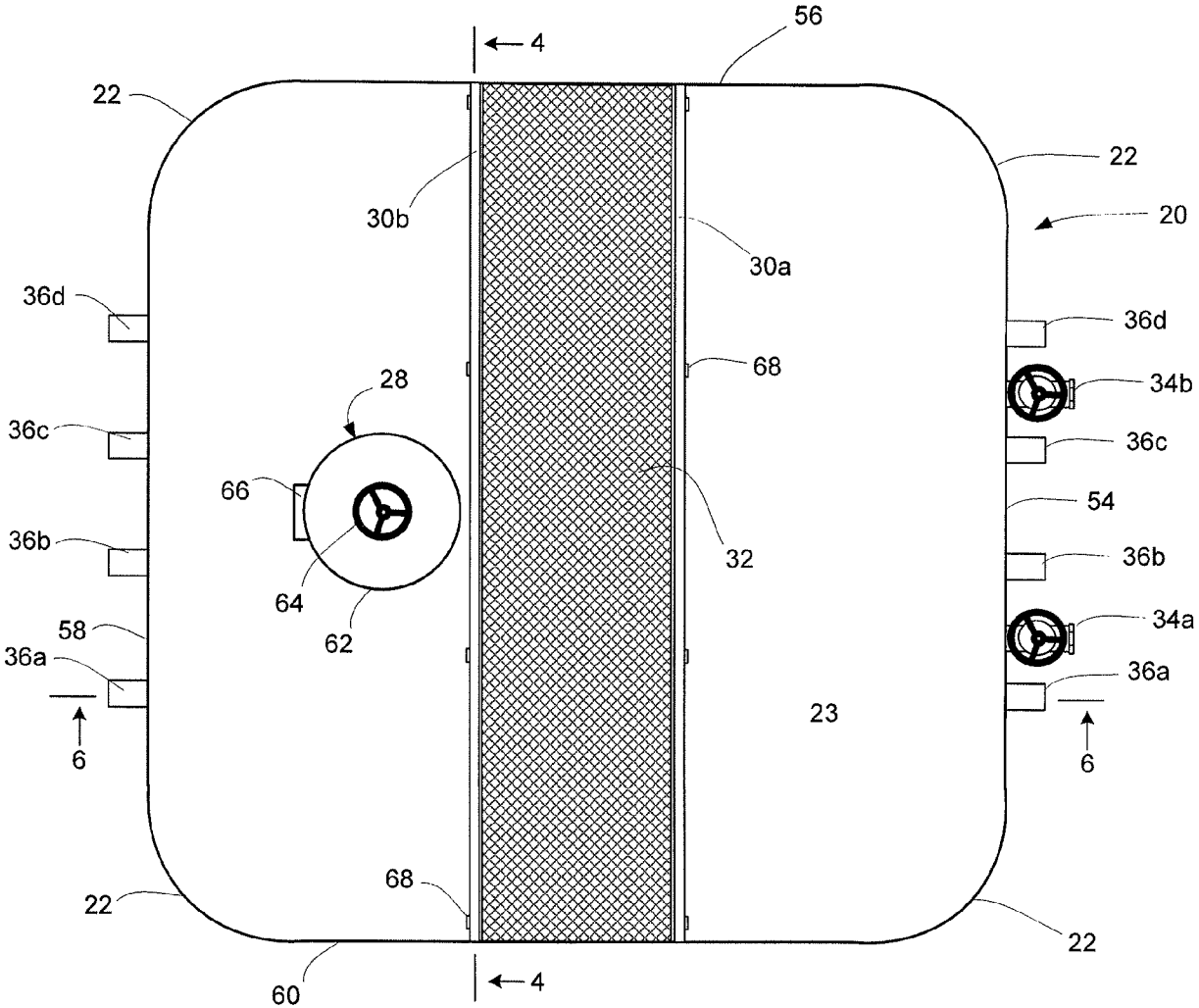
FIG. 3 is a schematic top plan view of the portable fluid storage tank shown in FIG. 1.

FIG. 3 is a schematic top plan view of the portable fluid storage tank 20 shown in FIG. 1. As explained above, the top of the portable fluid storage tank 20 is provided with handrails 30*a*, 30*b*. The handrails 30*a*, 30*b* flank opposite sides of a walkway 32 which extends between the sidewalls 56, 60. The handrails 30*a*, 30*b* are supported by posts 68 that slide inside tubes welded inside a top of the portable fluid storage tank 20, as will be explained below in more detail with reference to FIG. 4. The walkway 32 is preferably constructed of steel plate with a textured surface, or some other non-slip surface treatment. In this embodiment, the manhole 28 is about 2' (61 cm) in diameter and includes a manhole cover 62 that is hinged to the top wall 23 of the portable fluid storage tank 20 by a hinge 66 to permit the manhole cover 62 to be easily displaced so that fluid levels can be checked, etc. In this embodiment, the manhole 28 is round and the cover 62 is secured by a locking mechanism (not shown) operated by a hand wheel 64, well known in the art. It should be understood that any shape of manhole and any type of manhole cover can be used, as can any type of locking mechanism for the cover.

Figures 4, 5:
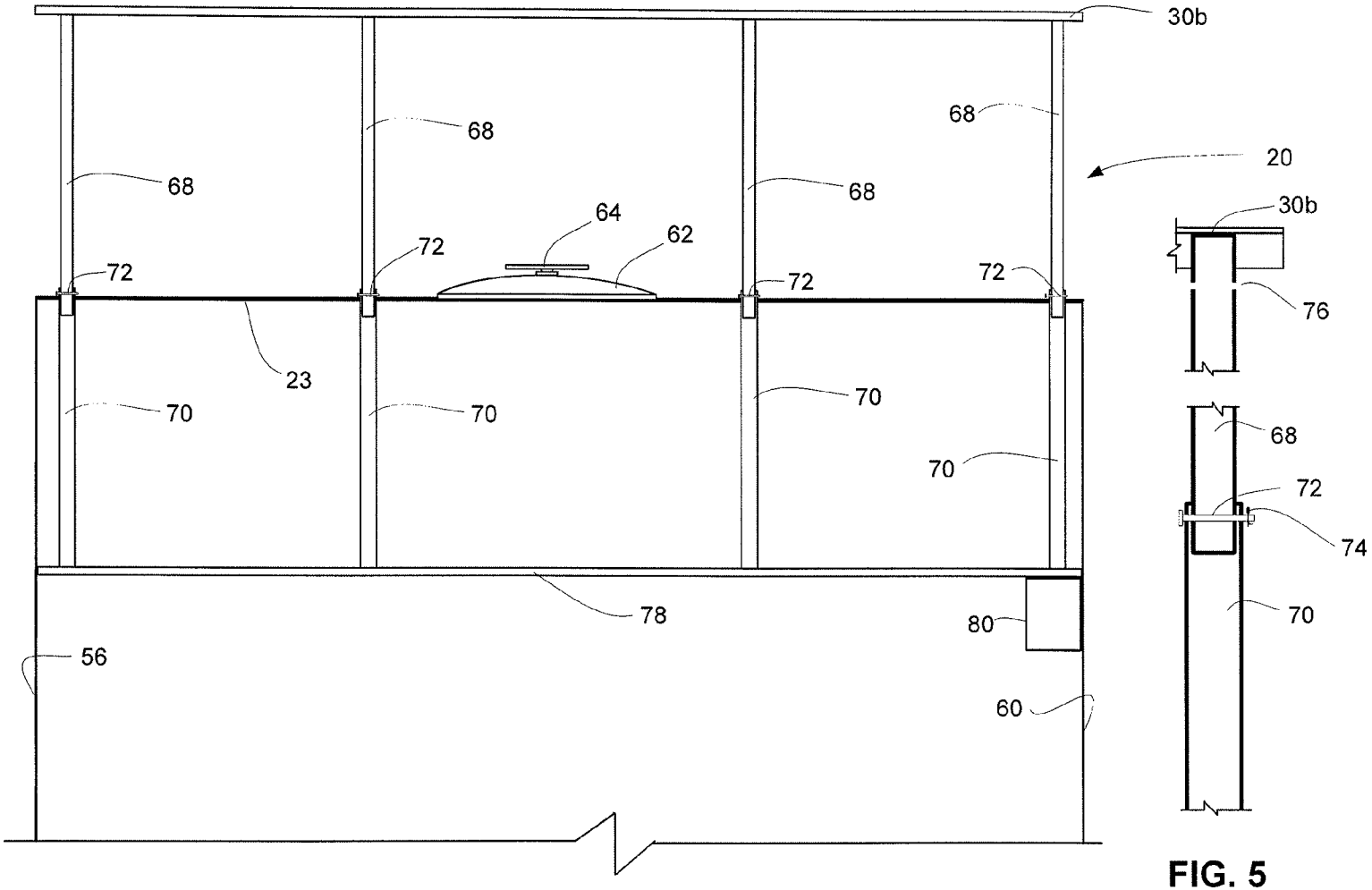
FIG. 4 is a schematic cross-sectional view of a top end of the portable fluid storage tank shown in FIG. 1, taken along lines 4-4 of FIG. 3.
FIG. 5 is a partial cross-sectional view of a handrail shown in FIG. 4.

FIG. 4 is a schematic cross-sectional view of a top end of the portable fluid storage tank 20 shown in FIG. 1, taken along lines 4-4 of FIG. 3. As explained above, the handrails 30*a* and 30*b* are supported by posts 68, which are tubular or solid members that are received in hollow tubes 70. The posts 68 and the tubes 70 may have any cross-sectional shape that permits the handrails 30*a* and 30*b* to be easily raised from a lowered position for transport to a raised position for field use, and vice versa. The tubes 70 extend through holes in the top wall 23 and are welded to the top wall 23. Transverse bores near a top end of the tubes 70 and complementary bores through a bottom of the posts 68 receive pins 72 to lock the posts 68 in the raised position. A stabilizer 78, which may be of plate or tubular stock, extends between the sidewalls 56 and 60 and is welded or otherwise secured to the respective sidewalls. The stabilizer 78 is welded to a bottom of each tube 70 to stabilize the respective tubes 70 and prevent fluid from migrating from the portable fluid tank into the bottom end of the tubes 70. A rectangular beam 80 is welded to the sidewall 60 and to a bottom of the stabilizers 78. The rectangular beam 80 reinforces the sidewall 60 at the latch windows, as will be explained below with reference to FIG. 7.

FIG. 5 is a partial cross-sectional view of the handrail 30*b* shown in FIG. 4. As explained above, the posts 68 are supported in the raised position by pins 72 that are locked in place by lock pins 74, which may be self-locking pins well known in the art, or any other suitable type of fastener. A transverse bore 76 through a top of the posts 68 near the handrail 30*b* is used to lock the handrails in the lowered, transport position shown in FIG. 1. The pins 72 and the lock pins 74 are used to lock the posts 68 in the lowered position.

Figure 6:
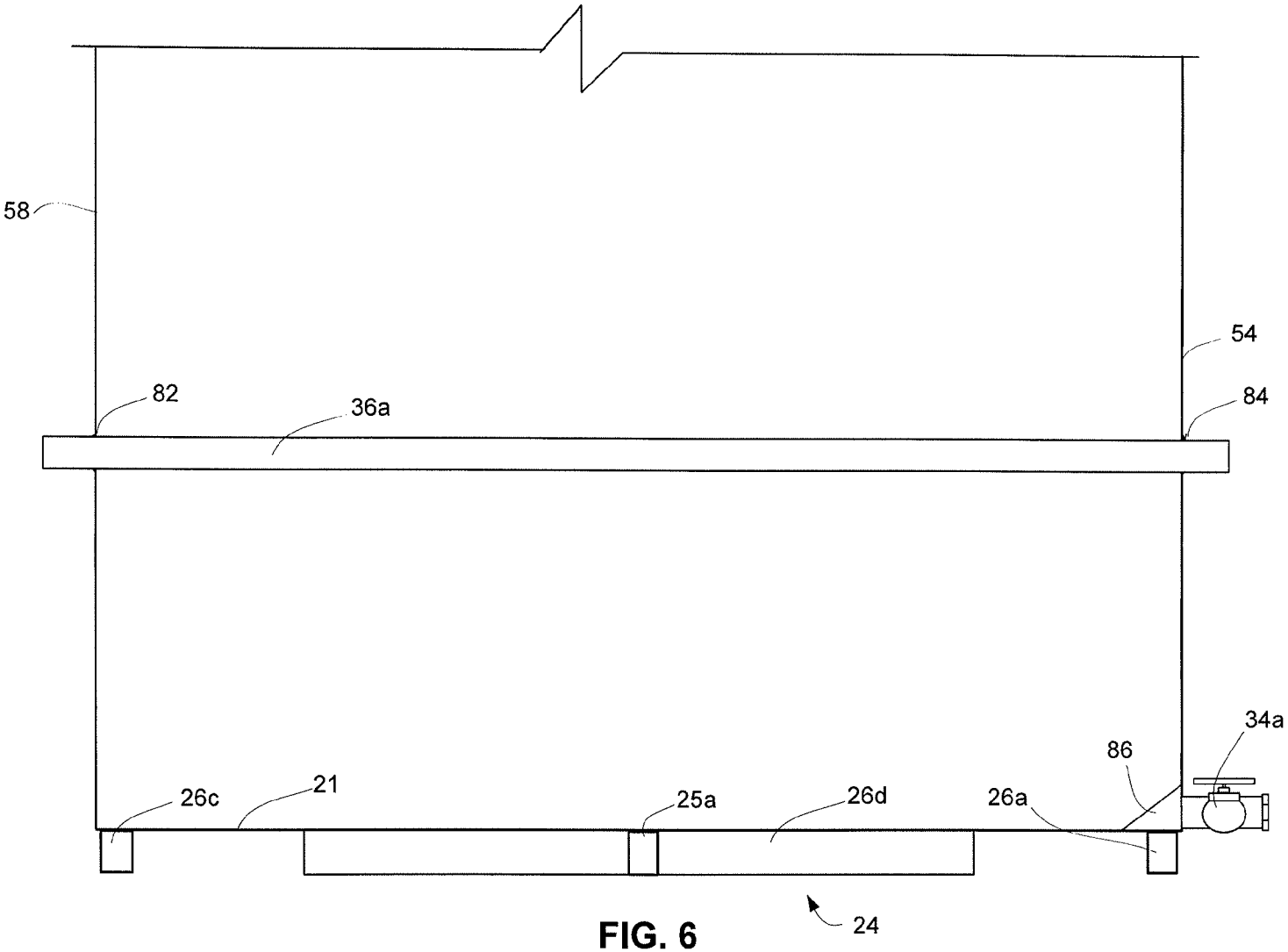
FIG. 6 is a schematic cross-sectional view of a bottom end of the portable fluid storage tank shown in FIG. 1, taken along lines 6-6 of FIG. 3.

FIG. 6 is a schematic cross-sectional view of a bottom end of the portable fluid storage tank 20 shown in FIG. 1, taken along lines 6-6 of FIG. 3. In this cross-section, only the through pipe 36*a* can be seen. Each of the through pipes 36*a*-36*d* extends completely through the portable fluid storage tank 20, and opposed ends of each through pipe 36*a*-36*d* extend about 6" (15 cm) beyond the respective front sidewall 54 and the rear sidewall 58. As can be seen, there is no fluid communication between the through pipes 36*a*-36*d* and the inside of the portable fluid storage tank 20. The through pipes 36*a*-36*d* in this embodiment are conveniently located at about 3'6" (1.09 m) above a top of the base 24. However, the through pipes 36*a*-36*d* may be located any convenient distance above the base 24. The through pipes 36*a*-36*d* are inserted through holes cut in the front sidewall 54 and the rear sidewall 58. A circumferential weld 82 secures the through pipe 36*a* to the rear sidewall 58 of the portable fluid storage tank 20. A circumferential weld 84 secures of the through pipe 36*a* to the front sidewall 54. The other through pipes 36*b*-36*d* are welded to the front sidewall 54 and a rear sidewall 58 in the same way.

As can be seen, the drain valves 34*a*, 34*b* are located as close to the bottom wall 21 as practical. A gusset 86 may be welded, on one or both sides of the valve opening (not shown), to the bottom wall 21 and the bottom of the front sidewall 54 to reinforce the front sidewall 54 against strain induced by the connection of the hoses, etc. to the drain valves 34*a*, 34*b*.

Figure 7:
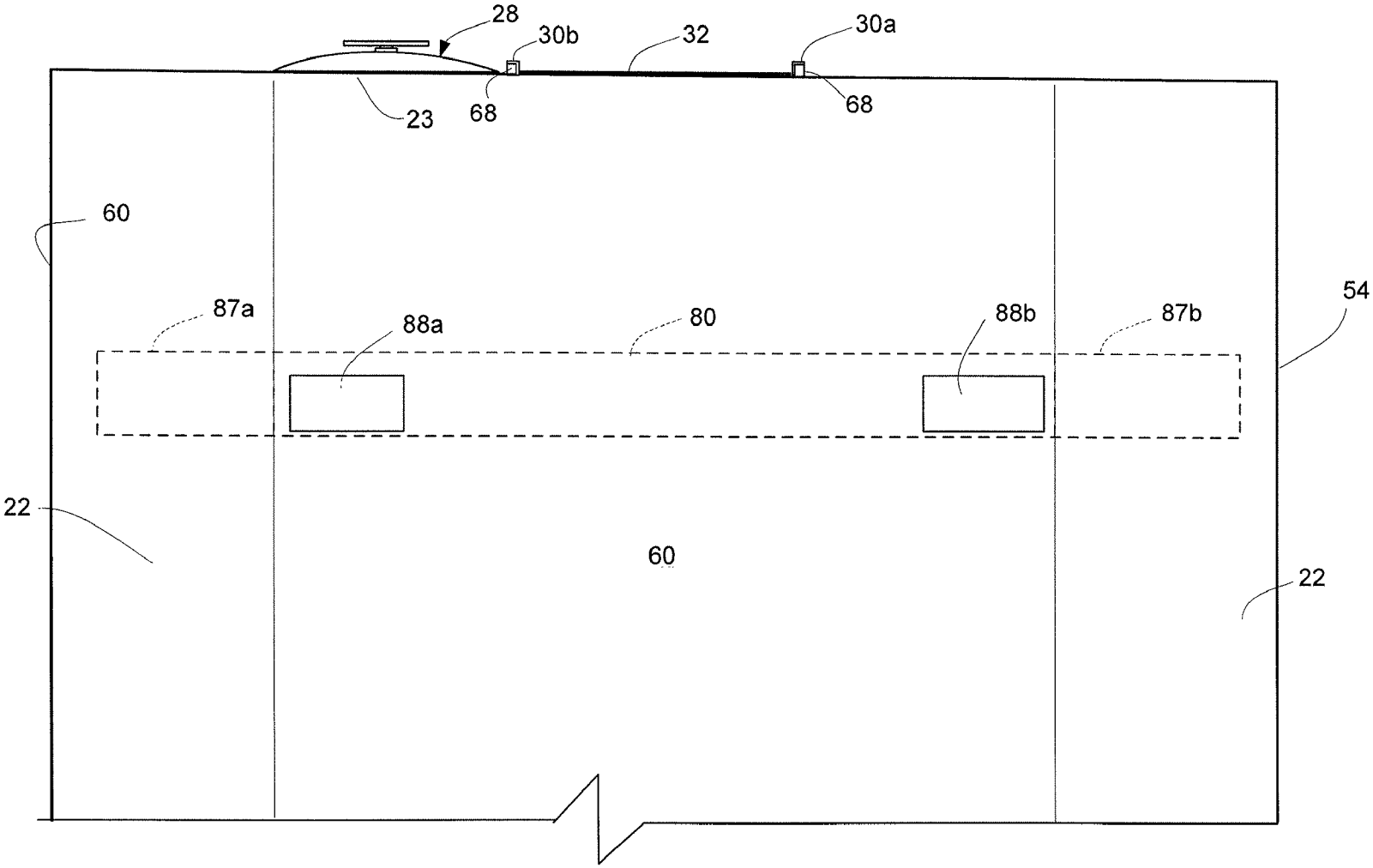
FIG. 7 is a schematic side elevational view of the top end of the portable fluid storage tank shown in FIG. 1, illustrating latch windows engaged by hydraulic latches of the tilting truck bed shown in FIG. 1 to secure the portable fluid storage tank to the tilting truck bed.

FIG. 7 is a schematic side elevational view of a top end of the portable fluid storage tank 20 shown in FIG. 1, illustrating latch windows 88*a*, 88*b* that are engaged by the hydraulic latches 50 of the tilting truck bed 42 (FIG. 1) to secure the portable fluid storage tank 40 to the tilting truck bed 42. In this embodiment, a 6"×8" rectangular tubular beam 80 having a wall thickness of about ⅜" (9.5 mm). The tubular beam 80 has opposite ends 87*a*, 87*b* that are respectively contoured to closely mate with the rounded corners 22 of the sidewall 60. The top, bottom and end edges of the tubular beam are welded to the sidewall 60 and the rounded corners 22 so that there is no fluid communication between the inside of the portable fluid storage tank 20 and the tubular beam 80, and so that the tubular beam 80 is securely bonded to the sidewall 60 and the rounded corners 22. The latch windows 88*a*, 88*b* are cut through the sidewall 60 and the front side of the tubular beam 80. Angle iron or channel iron (not shown) may be welded around the perimeter of each of the windows 88*a*, 88*b* to further reinforce them. In this embodiment, the latch windows 88*a*, 88*b* are respectively about 12 inches (30 cm) long and 6 inches (15 cm) high.

Figure 8:
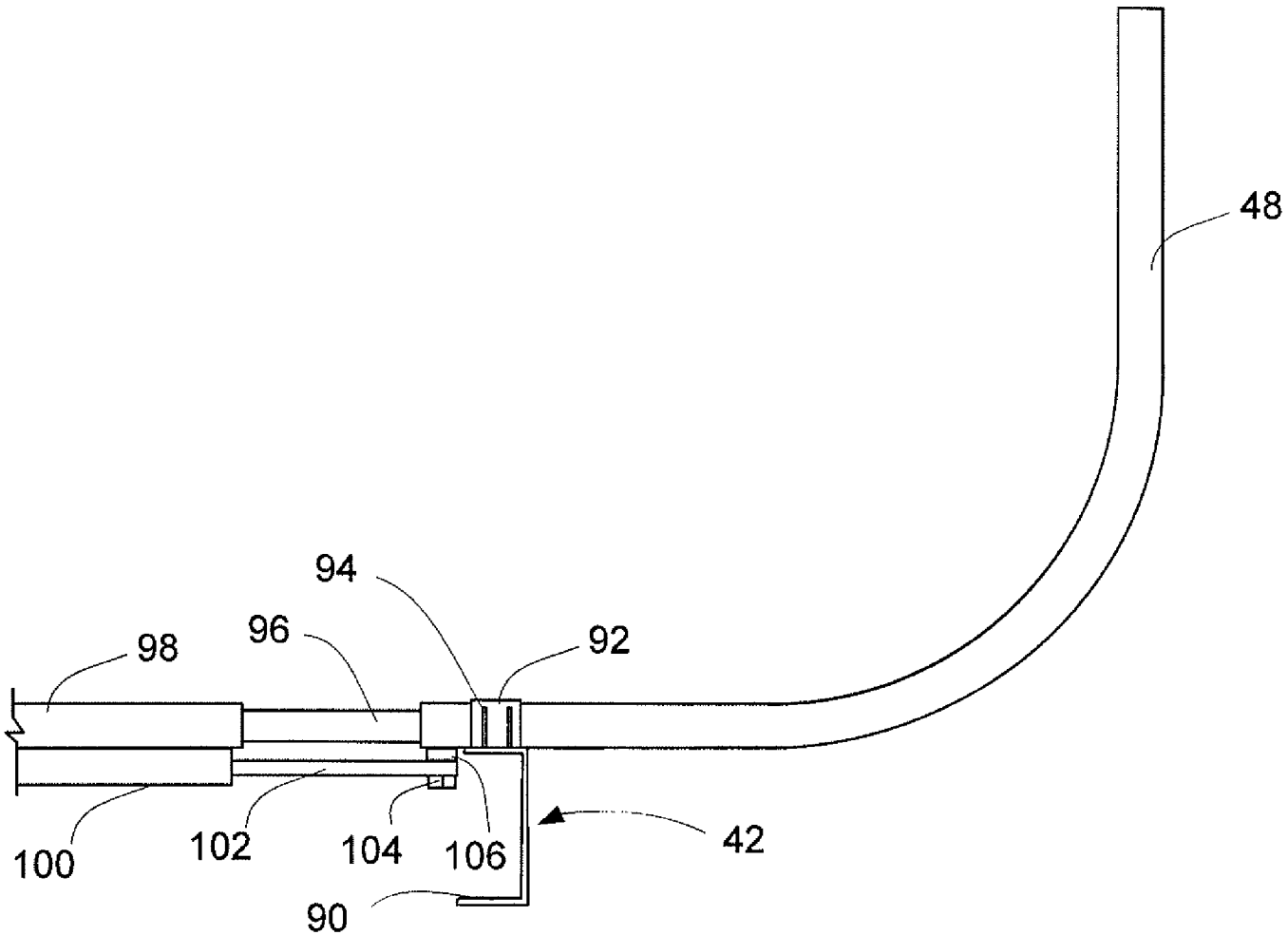
FIG. 8 is a schematic diagram of a portion of a cradle of the tilting truck bed used to transport the portable fluid storage tank shown in FIG. 1.

FIG. 8 is a schematic diagram of one cradle arm 48 of the tilting truck bed 42 used to transport the portable fluid storage tank shown in FIG. 1. In order to facilitate pickup or drop-off of the portable fluid storage tank 20 from/to a surface that may not be perfectly level, the cradle arms 48 on at least one side of the tilting truck bed 42 are preferably movable from a retracted transport position to an extended pickup and drop-off position. The cradle arm 48 shown in FIG. 8 is in the extended pickup/drop-off position. The cradle arm 48 reciprocates through a housing 92, which may be constructed of tubular material. The housing 92 is welded or otherwise secured to a frame member 90 of the tilting truck bed 42 by gussets 94, or any other suitable fastener. At least the inner end of the cradle arm 48 is hollow and slides over bar stock 96 secured to a cradle bed 98 also supported (not shown) by the tilting truck bed 42. A hydraulic cylinder 100 is used to reciprocate the cradle arm 48 from the retracted transport position to the extended pickup position. A piston rod 102 of the hydraulic cylinder 100 is connected by a fastener 104 and a bushing 106 to the cradle arm 48. The other cradle arms 48 on the same side of the tilting truck bed 42 are constructed in the same way. Alternatively, all of the cradle arms on the same side of the tilting truck bed 42 may be connected to a single hydraulic cylinder through a linkage (not shown) to move them from the travel position to the pickup/drop-off position.

Figure 9:
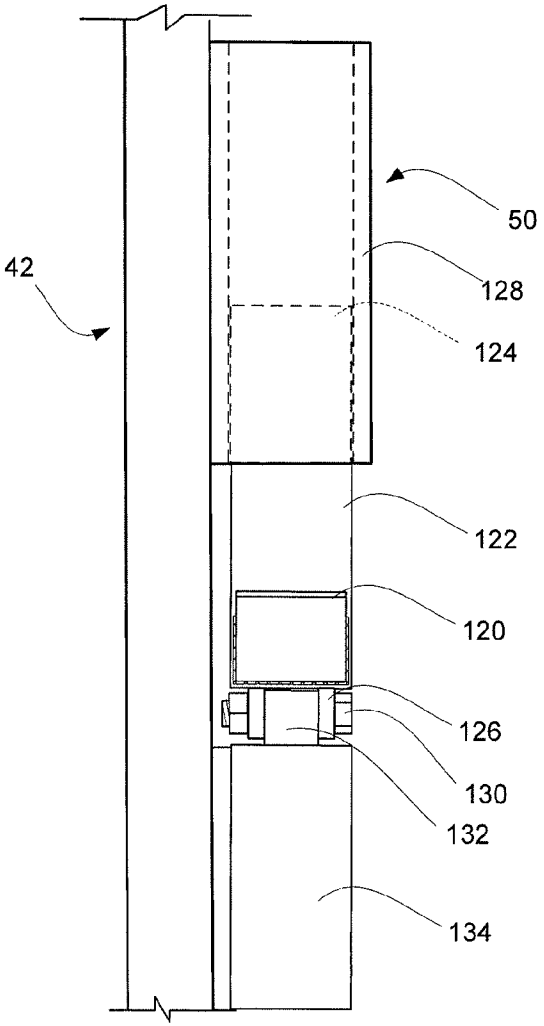
FIG. 9 is a schematic front elevational view of a hydraulic latch of the tilting truck bed shown in FIG. 1.

FIG. 9 is a schematic front elevational view of one of two hydraulic latches 50 of the tilting truck bed 42 shown in FIG. 1. Each of the hydraulic latches 50 has an outwardly extending tongue 120, in this embodiment about 6 inches (15 cm) long and about 6 inches (15 cm) wide that is welded to a tubular or bar stock 122 having a free top end 124 and a journaled bottom end 126. The free top end 124 is received in a tubular guide member 128 and reciprocates therein. The journaled bottom end 126 is secured by a fastener 130 to a ram 132 of a hydraulic cylinder 134. The hydraulic cylinder 134 and the tubular guide member 128 are respectively secured to the tilting truck bed 42.

Figure 10:
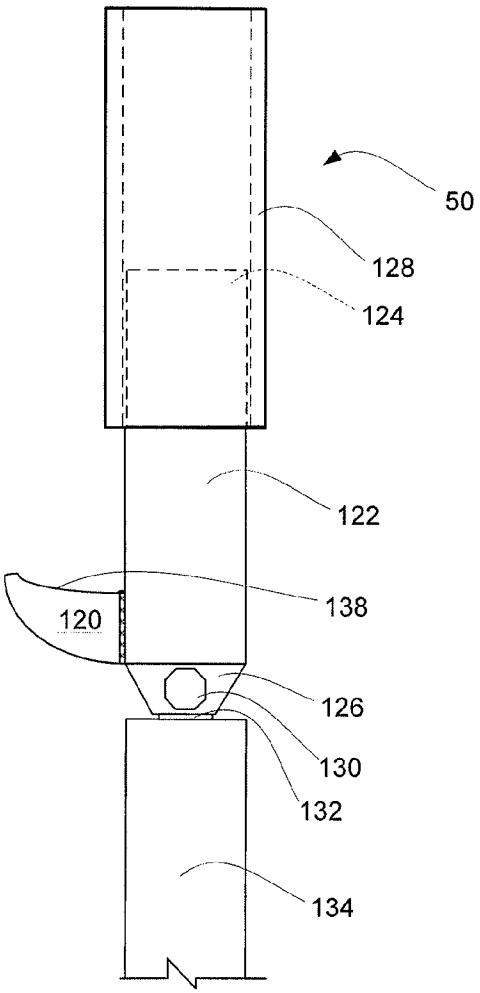
FIG. 10 is a schematic side elevational view of the hydraulic latch shown in FIG. 9.

FIG. 10 is a schematic side elevational view of the hydraulic latch 50 shown in FIG. 9. The tilting truck bed 42 is not shown in this figure. As shown in FIG. 1, the two hydraulic latches are positioned on the tilting truck bed 42 so that the outwardly extending tongues 120 enter the respective latch windows 88*a* and 88*b* when the truck is backed up in proper alignment against the portable fluid storage tank 20. When the rams 132 of the hydraulic cylinders 134 are extended, the downward and inward curvatures 138 of the outwardly extending tongues 120 of the hydraulic latches 50 urge the portable fluid storage tank 20 against the tilting truck bed 42. A cradle arm control is then operated to move the cradle arms to the travel position, as discussed above with reference to FIG. 8. Further extension of the rams 132 raises the portable fluid storage tank 20 until the top end abuts the tilting truck bed end plate 52 (FIG. 1), which locks the portable fluid storage tank 20 to the tilting truck bed 42. After the portable fluid storage tank 20 is locked to the tilting truck bed 42, the tilting truck bed 42 can be lowered into the transport position and the portable fluid storage tank 20 hauled to another location without additional strapping. To offload the portable fluid storage tank 20, the loading operation is reversed, which permits the truck driver to offload the tank without assistance or auxiliary equipment and without any requirement to handle the tank or other equipment.

Figure 11:
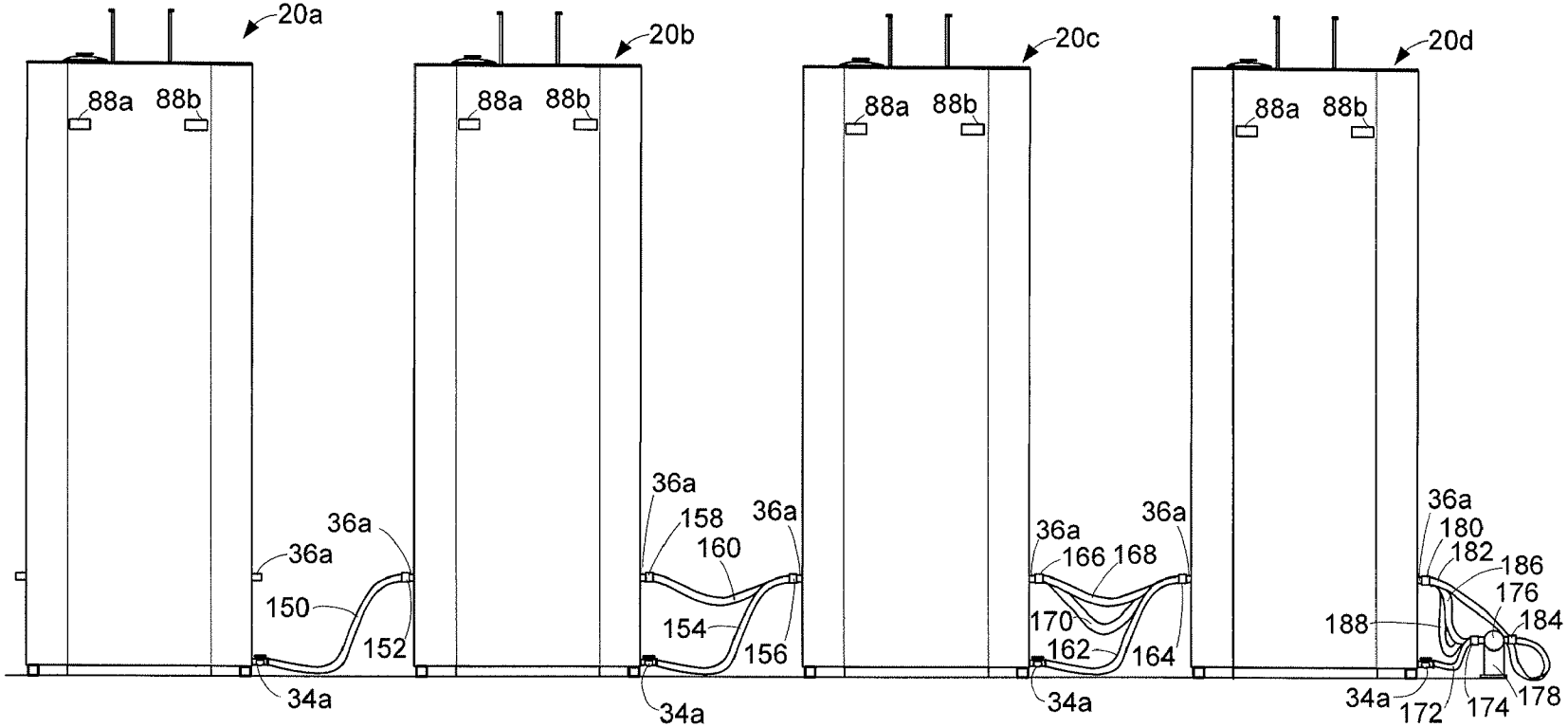
FIG. 11 is a schematic side elevational view of one column of four portable fluid storage tanks in accordance with the invention connected to a frac fluid manifold at a well site.

FIG. 11 is a schematic side elevational view of one column of four portable fluid storage tanks 20*a*-20*d* connected to a frac fluid manifold 176 at a well site. The embodiment of the portable fluid storage tank 20 shown in FIGS. 1-8 permits up to 5 rows of frac tanks 20 to be connected to a single frac manifold 176. The number of columns of tanks connected to the frac manifold is limited only by the length of the frac manifold 176 and/or the size of the well site. It should also be understood that the number of rows of portable fluid storage tanks 20 in a column is limited only by the number of through pipes 36 with which each portable fluid storage tank 20 is provisioned. Four through pipes 36 is exemplary only and any number of through pipes 36 may be provided in the portable fluid storage tank 20 in accordance with the invention.

In the example shown in FIG. 11, the drain valve 34*a* of the portable fluid storage tank 20*a* is connected by a flexible hose 150 and a suitable connector 152 to the through pipe 36*a* of the portable storage tank 20*b*. The drain valve 34*a* of the portable fluid storage tank 20*b* is connected via hose 154 and connector 156 to the through pipe 36*a* of the portable fluid storage tank 20*c*. The through pipe 36*a* of the portable fluid storage tank 20*b* is connected to the through pipe 36*b* (not visible) of the portable fluid storage tank 20*c* by the connector 158 and the flexible hose 160. The drain valve 34*a* of the portable fluid storage tank 20*c* is connected via hose 162 and connector 164 to the through pipe 34*a* of the portable fluid storage tank 20*d*. The through pipe 36*a* of the portable fluid storage tank 20*c* is connected via hose connector 166 and hose 168 to the through pipe 36*b* (not visible) of portable fluid storage tank 20*d*. The through pipe 36*c* (not visible) of the portable fluid storage tank 20*c* is connected via connectors (not visible) and hose 170 to the through pipe 36*c* (not visible) of the portable fluid storage tank 20*d*.

The drain valve 34*a* of the portable fluid storage tank 20*d* is connected via hose 172 and connector 174 to the frac manifold 176, which is supported by frac manifold base 178. The through pipe 36*a* of the portable fluid storage tank 20*d* is connected via connectors 180 and 184 and hose 182 to the frac manifold 176. The through pipe 36*b* (not visible) is connected to the frac manifold 176 by hose 186 and appropriate connectors (not visible), and the through pipe 36*c* (not visible) of the portable fluid storage tank 20*d* is connected to the frac manifold 176 by hose 188 and appropriate connectors (not visible).

Thus, each of the portable fluid storage tanks 20*a*-20*d* is connected by a segregated fluid path to the frac manifold 176. Fluid flow from any one of the portable fluid storage tanks 20*a*-20*d* can be controlled using the respective drain valves and/or by frac manifold control functions available through a frac manifold control panel (not shown). Hose use and hose clutter is kept to a minimum and storage tank clustering density is substantially increased, so the well site space required for fracturing fluid storage is significantly reduced. It should be noted that the hose connections shown in FIG. 11 may be rigid pipe connections, the fluid paths between the respective portable fluid storage tanks 20*a*-20*d* can be daisy-chained to the through pipes 36 in any order without affecting the integrity of the segregated fluid path, and the distance between the rows of portable fluid storage tanks can be reduced to any comfortable working space, i.e. as little as 2'-3' (0.6-1 m).

Figure 12:
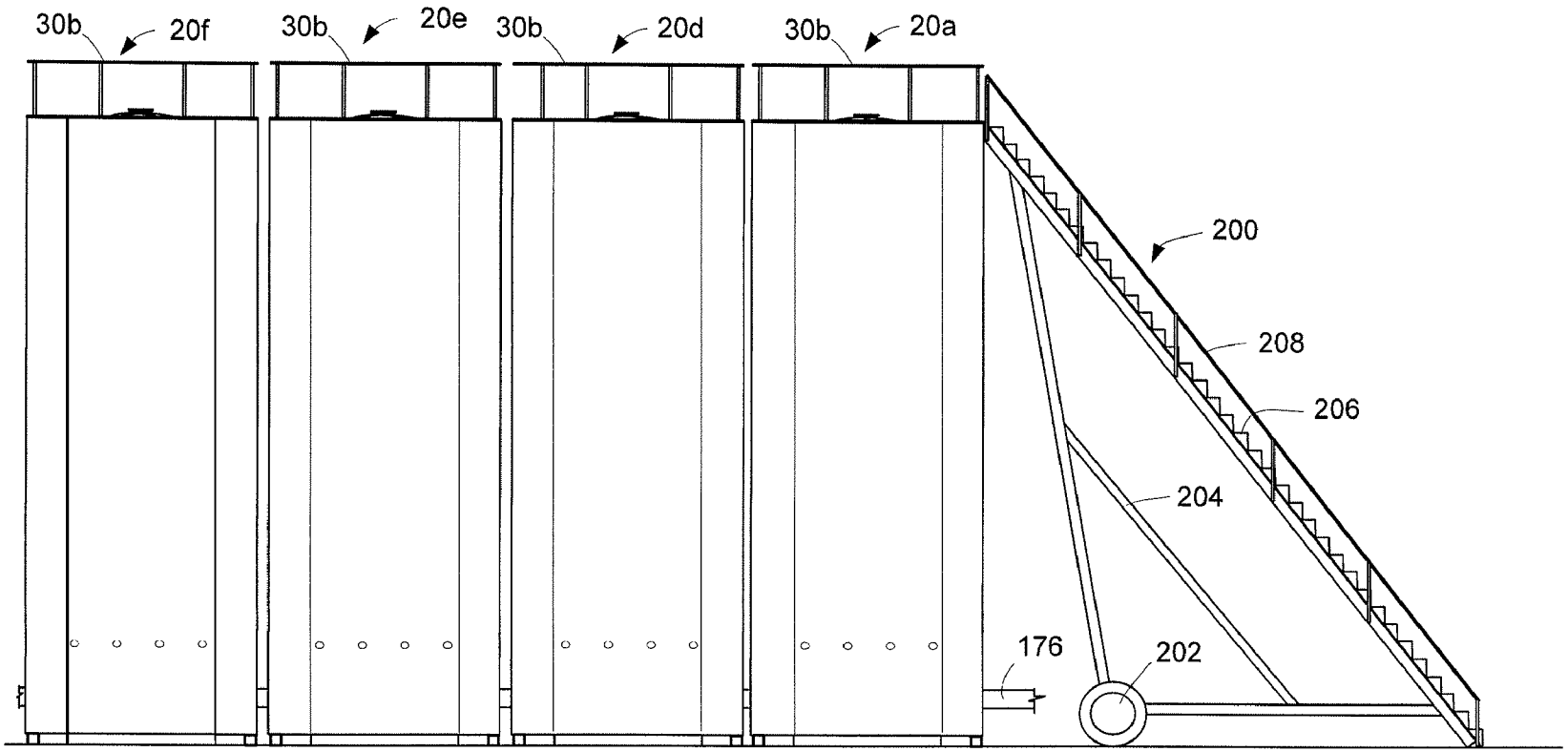
FIG. 12 is a rear elevational view of a row of four columns of the portable fluid storage tanks shown in FIG. 11.

FIG. 12 is a rear elevational view of a row of four adjacent columns of the portable fluid storage tanks 20 shown in FIG. 11. Because of space constraints, only the row farthest from the frac manifold 176, and only four columns of that row are shown. The portable fluid storage tanks 20*a* (see FIG. 11), 20*d*, 20*e* and 20*f* are positioned as closely together as is practical. Site conditions will have an effect, but 2"-10" (15-37.5 cm) between the portable fluid storage tanks 20 in adjacent columns is normally achievable. After all of the portable fluid storage tanks 20 for a given row have been delivered and positioned, a portable stairway 200, or the like, is set up on one end of the row. The portable stairway 200 is available in many different styles, and well known in the art. It has wheels 202 that permit it to be towed to a well site using a tow bar (not shown). A height adjustment mechanism schematically shown at 204 is used to adjust the stairway to the required height (30'). The stairs 206 and the handrails 208 are self-leveling.

The portable stairway 200 provides access to a top of the row of portable fluid storage tanks 20. Once access is gained, the handrails 30 are raised and locked in place, as explained above with reference to FIGS. 4 and 5. The handrails 30*a*, 30*b* help ensure that a row of the portable fluid storage tanks 20 can be more safely traversed by the frac crew, if required.

The portable fluid storage tanks 20 described above are square with rounded corners. However, it should be understood that they may be rectangular or cylindrical without departing from the spirit or scope of the invention. Furthermore, although the portable fluid storage tanks 20 described above are constructed from steel plate, fiberglass or plastic could be used for the same purpose.

The embodiments of the invention described above are therefore intended to be exemplary only. The scope of the invention is intended to be limited solely by the scope of the appended claims.

I claim:

1. A portable fluid storage tank, comprising:

a base that supports the portable fluid storage tank in an upright position;

a bottom wall connected to the base;

at least one sidewall connected to the bottom wall;

a top wall connected to the at least one sidewall;

at least one through pipe having opposed ends, the at least one through pipe extending through the at least one sidewall at two separate places so that the respective opposed ends of the at least one through pipe are exposed on an exterior of the portable fluid storage tank and the at least one through pipe provides a fluid path through the portable fluid storage tank without fluid communication between the at least one through pipe and an interior of the portable fluid storage tank; and at least one drain valve through which fluid may be removed from the portable fluid storage tank.

2. The portable fluid storage tank as claimed in claim 1 wherein the bottom wall and the top wall are square with rounded corners.

3. The portable fluid storage tank as claimed in claim 2 wherein the at least one sidewall comprises four sidewalls interconnected by rounded corners.

4. The portable fluid storage tank as claimed in claim 1 wherein the base comprises rectangular steel tubing welded to the bottom wall.

5. The portable fluid storage tank as claimed in claim 1 further comprising a manhole in the top wall.

6. The portable fluid storage tank as claimed in claim 1 further comprising a walkway that traverses the top wall.

7. The portable fluid storage tank as claimed in claim 6 further comprising handrails that flank opposite sides of the walkway.

8. The portable fluid storage tank as claimed in claim 7 wherein the handrails are displaceable from a lowered transport position to a raised use position.

9. The portable fluid storage tank as claimed in claim 8 wherein the handrails are supported by posts that slide inside hollow tubes having top ends that are connected to the top wall.

10. The portable fluid storage tank as claimed in claim 1 further comprising two spaced-apart latch windows in the at least one sidewall, into which outwardly extending tongues of two correspondingly spaced-apart hydraulic latches are inserted to releasably connect the portable fluid storage tank to a tilting transport vehicle bed to which the two correspondingly spaced-apart hydraulic latches are mounted.

11. A portable fluid storage tank, comprising:

a base that supports the portable fluid storage tank in an upright position;

a bottom wall connected to the base;

four sidewalls connected to the bottom wall;

a top wall connected to the four sidewalls;

a plurality of through pipes respectively having opposed ends, the plurality of through pipes respectively extending through two opposed ones of the four sidewalls, so that the respective opposed ends of the respective plurality of through pipes are exposed on an exterior of the portable fluid storage tank and the plurality of through pipes respectively provide a fluid path through the portable fluid storage tank without fluid communication between any one of the plurality of through pipes and an interior of the portable fluid storage tank; and at least one drain valve through which fluid may be removed from the portable fluid storage tank.

12. The portable fluid storage tank as claimed in claim 11 further comprising a walkway connected to the top of the top wall, with a collapsible handrail on each side of the walkway.

13. The portable fluid storage tank as claimed in claim 11 wherein the bottom wall and the top wall are square with rounded corners.

14. The portable fluid storage tank as claimed in claim 11 wherein a drain opening for the at least one drain valve is located in one of the sidewalls directly above the bottom wall and the drain valve is connected to the one of the side walls.

15. The portable fluid storage tank as claimed in clam 14 wherein one end of the plurality of through pipes respectively extends through the one of the sidewalls above the drain valve.

16. The portable fluid storage tank as claimed in claim 15 further comprising latch windows another one of the sidewalls, through which latches are inserted to connect the portable fluid storage tank to a tilting truck bed.

17. The portable fluid storage tank as claimed in claim 1 wherein the latch windows are reinforced by a tubular beam welded to the one of the sidewalls.

18. The portable fluid storage tank as claimed in claim 11 wherein the top wall further comprises a manhole with a manhole cover.

19. A portable fluid storage tank, comprising:

a base that supports the portable fluid storage tank in an upright position;

a bottom wall connected to the base;

sidewalls connected to the bottom wall;

a top wall connected to the sidewalls;

a through pipe having opposed ends, the through pipe extending through two of the sidewalls so that the respective opposed ends of the through pipe are exposed on an exterior of the portable fluid storage tank and the through pipe provides a fluid path through the portable fluid storage tank without fluid communication between the through pipe and an interior of the portable fluid storage tank; and a drain valve through which fluid may be removed from the portable fluid storage tank.

20. The portable fluid storage tank as claimed in claim 19 wherein the sidewalls are welded to the top wall; the side walls are welded to the bottom wall; the side walls are welded together; and, the through pipes are welded to respective ones of the two of the sidewalls.

* * * * *

UNITED STATES PATENT AND TRADEMARK OFFICE

CERTIFICATE OF CORRECTION

PATENT NO. : 8,215,516 B2
APPLICATION NO. : 10/498415
DATED : July 10, 2012
INVENTOR(S) : Patrick A. Kaupp It is certified that error appears in the above-identified patent and that said Letters Patent is hereby corrected as shown below:

In the Specification:

Column 4, line 12, please replace the number "7" with the number --8--.

Column 4, line 17, please replace the number "8" with the number --7--.

In the Claims:

Column 10, line 19, after the word "claim", please replace the number "1" with the number --16--.

Signed and Sealed this
Twenty-seventh Day of August, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,215,516 B2
APPLICATION NO. : 12/498418
DATED : July 10, 2012
INVENTOR(S) : Patrick A. Kaupp It is certified that error appears in the above-identified patent and that said Letters Patent is hereby corrected as shown below:

In the Specification:

Column 4, line 12, please replace the number "7" with the number --8--.

Column 4, line 17, please replace the number "8" with the number --7--.

In the Claims:

Column 10, line 19, after the word "claim", please replace the number "1" with the number --16--.

This certificate supersedes the Certificate of Correction issued August 27, 2013.

Signed and Sealed this
Twenty-fifth Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,215,516 B2
APPLICATION NO. : 12/498415
DATED : July 10, 2012
INVENTOR(S) : Patrick A. Kaupp It is certified that error appears in the above-identified patent and that said Letters Patent is hereby corrected as shown below:

In the Specification:

Column 4, line 12, please replace the number "7" with the number --8--.

Column 4, line 17, please replace the number "8" with the number --7--.

In the Claims:

Column 10, line 19, after the word "claim", please replace the number "1" with the number --16--.

This certificate supersedes the Certificates of Correction issued August 27, 2013 and February 25, 2014.

Signed and Sealed this
Tenth Day of June, 2014

Michelle K. Lee

Michelle K. Lee
*Deputy Director of the United States Patent and Trademark Office*